US007764150B2

(12) United States Patent
Dale

(10) Patent No.: US 7,764,150 B2
(45) **Date of Patent: *Jul. 27, 2010**

(54) WAVEGUIDE QUICK DISCONNECT CLAMP

(75) Inventor: James L. Dale, Lawrenceville, GA (US)

(73) Assignee: Rockwell Collins Satellite Communications Systems, Inc., Duluth, GA (US)

( * ) Notice: Subject to any disclaimer, the term of this patent is extended or adjusted under 35 U.S.C. 154(b) by 6 days.

This patent is subject to a terminal disclaimer.

(21) Appl. No.: 12/203,757

(22) Filed: Sep. 3, 2008

(65) Prior Publication Data

US 2008/0315979 A1 Dec. 25, 2008

Related U.S. Application Data

(63) Continuation of application No. 11/475,409, filed on Jun. 27, 2006, now Pat. No. 7,436,275.

(51) Int. Cl.
*H01P 1/00* (2006.01)
*H01P 5/00* (2006.01)

(52) U.S. Cl. ..... 333/255; 333/256; 333/260

(58) Field of Classification Search ..... None
See application file for complete search history.

(56) References Cited

U.S. PATENT DOCUMENTS

| | | | | |
|---|---|---|---|---|
| 2,691,201 | A | 10/1954 | Matthews | |
| 2,726,694 | A | 12/1955 | Saxton | |
| 2,988,122 | A | 6/1961 | Stevens et al. | |
| 3,821,670 | A | 6/1974 | Thompson | |
| 4,245,827 | A | 1/1981 | Goff et al. | |
| 4,258,908 | A | 3/1981 | Goff et al. | |
| 4,514,708 | A | 4/1985 | Ludtke | |
| 4,686,498 | A | 8/1987 | Carr et al. | |
| 4,795,361 | A | 1/1989 | Trojanowski | |
| 4,962,991 | A | 10/1990 | Carvalho | |
| 5,166,650 | A | 11/1992 | Simmons et al. | |
| 6,140,893 | A | 10/2000 | Sciarrino | |
| 6,893,012 | B2 | 5/2005 | Wong | |
| 7,436,275 | B2 * | 10/2008 | Dale | 333/255 |

OTHER PUBLICATIONS

International Preliminary Report on Patentability mailed Jan. 15, 2009.

(Continued)

*Primary Examiner*—Anh Q Tran
(74) *Attorney, Agent, or Firm*—Nelson Mullins Riley & Scarborough, LLP

(57) ABSTRACT

A waveguide quick disconnect clamp includes a first arm and a second arm, both arms having a first end, a second end, and a jaw pivotally connected to the second end. Each of the first and second arm jaws has a generally flat engaging face defining two generally parallel elongated sections and a waveguide receiving recess therebetween. The second arm second end is pivotally connected to the first arm at a position intermediate the first arm first and second ends, and a threaded nut is pivotally connected to the first arm first end. The waveguide quick disconnect clamp also has an adjustment screw having a first end, a second end, and a threaded portion therebetween. The adjustment screw first end pivotally engages the second arm at a point intermediate the second arm first and second ends, and the threaded portion of the screw engages the threaded nut.

20 Claims, 9 Drawing Sheets

OTHER PUBLICATIONS

Waveguide Quick Disconnect web printout Dec. 2, 2005, Advanced Technical Materials, Inc.

Wrap Around Quick Disconnect Waveguide Clamp web printout Dec. 2, 2005, Astrolab, Inc.

Quick Disconnect web printout Dec. 2, 2005, Hyper Technologies.

PCT International Search Report dated Sep. 22, 2008.

PCT Written Opinion dated Sep. 22, 2008.

* cited by examiner

WAVEGUIDE QUICK DISCONNECT CLAMP

This application is a continuation of U.S. patent application Ser. No. 11/475,409, filed on Jun. 27, 2006, the entire disclosure of which is incorporated by reference herein.

FIELD OF THE INVENTION

The present invention relates to clamping tools and in particular to a waveguide clamp for quick assembly and disassembly of radio frequency waveguides.

BACKGROUND OF THE INVENTION

Waveguides are typically elongated square- or rectangular-shaped channels that help concentrate and direct radio frequency (RF) signals to improve radio communications. For mobile applications, waveguides frequently comprise multiple sections that may be disassembled for easy transport. Typically, mobile waveguides sections are equipped with a mating flange on each end that creates an interface between two mating sections. It is critical to properly align and securely assemble waveguide sections because misalignment of the sections may result in an interface discontinuity that may result in interference and distortion in the propagated signal and ultimately may disrupt the transmission of the RF signal. In the past, the flanges on the waveguide sections were equipped with mating through-holes, and standard nuts and bolts or other threaded fasteners were used to secure the mating flanges together. Such arrangements can be both time consuming to assemble and difficult to align.

Alternative methods of attaching the waveguide sections are known, such as using waveguide quick disconnects. However, such items provide inadequate clamping forces, which can also result in misalignment of the waveguide sections at the joint or may even allow the joint integrity to be compromised. Furthermore, such connections can be difficult to assemble in cold weather when an operator may be wearing insulated gloves.

SUMMARY OF THE INVENTION

The present invention recognizes and addresses considerations of prior art constructions and methods. In one embodiment of the present invention a waveguide quick disconnect clamp includes a first arm and a second arm, both arms having a first end, a second end, and a jaw pivotally connected to the second end. Each of the first and second arm jaws has a generally flat engaging face defining two generally parallel elongated sections and a waveguide receiving recess therebetween. The second arm second end is pivotally connected to the first arm at a position intermediate the first arm first and second ends, and a threaded nut is pivotally connected to the first arm first end. The waveguide quick disconnect clamp also has an adjustment screw having a first end, a second end, and a threaded portion therebetween. The adjustment screw first end pivotally engages the second arm at a point intermediate the second arm first and second ends, and the threaded portion of the screw adjustably engages the screw threads on the threaded nut. In this way, when an operator turns the adjustment screw in a jaw-closing direction, the first and second arm jaws approach each other so as to clamp two waveguide sections together.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
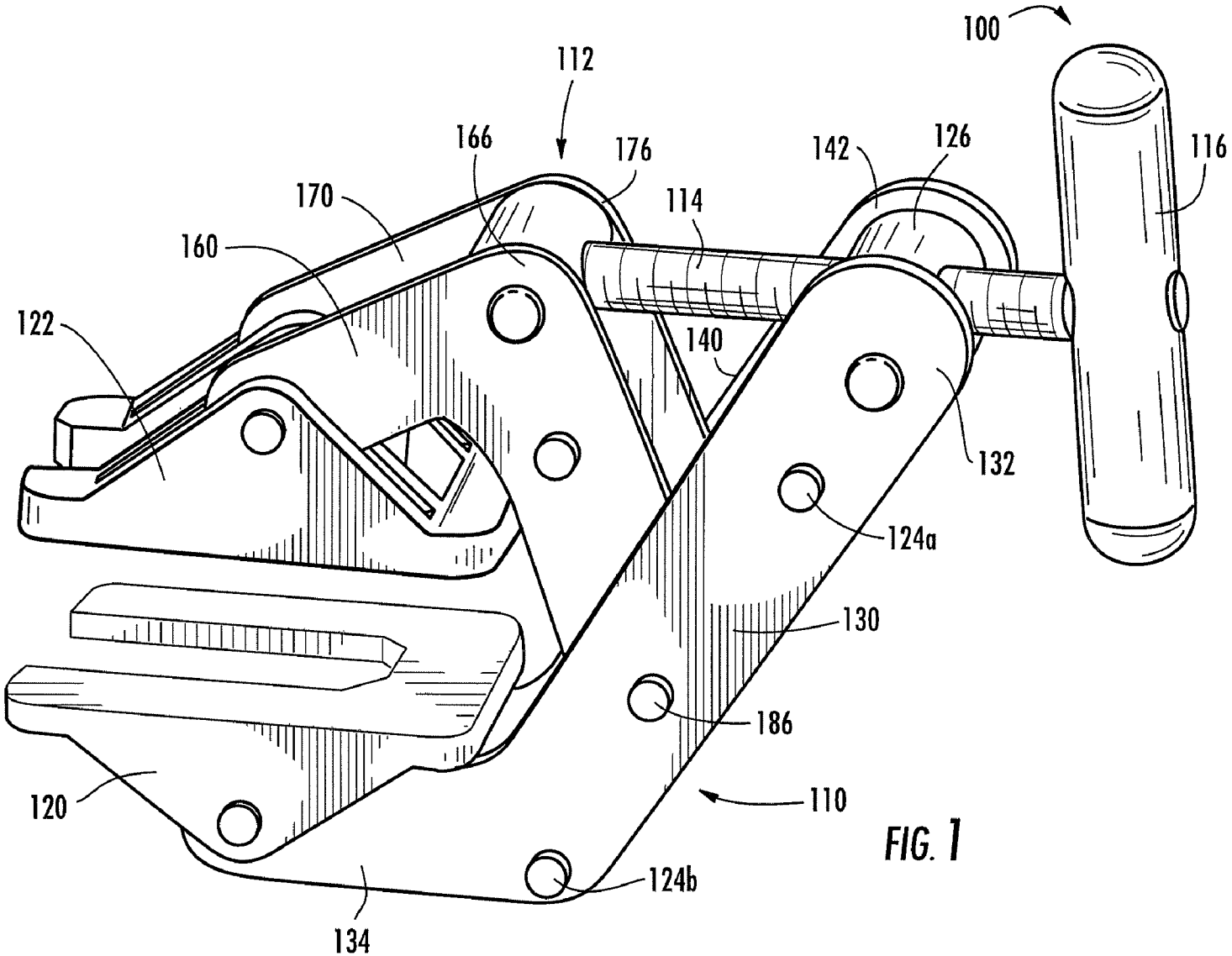
FIG. 1 is a perspective view of a waveguide quick disconnect clamp in accordance with an embodiment of the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, a waveguide quick disconnect clamp 100 in accordance with the present invention includes a first arm 110, a second arm 112, an adjustment screw 114, a handle 116, a first arm clamping jaw 120, and a second arm clamping jaw 122. First arm 110 has a first J-shaped plate 130 and a second J-shaped plate 140.

Figure 2:
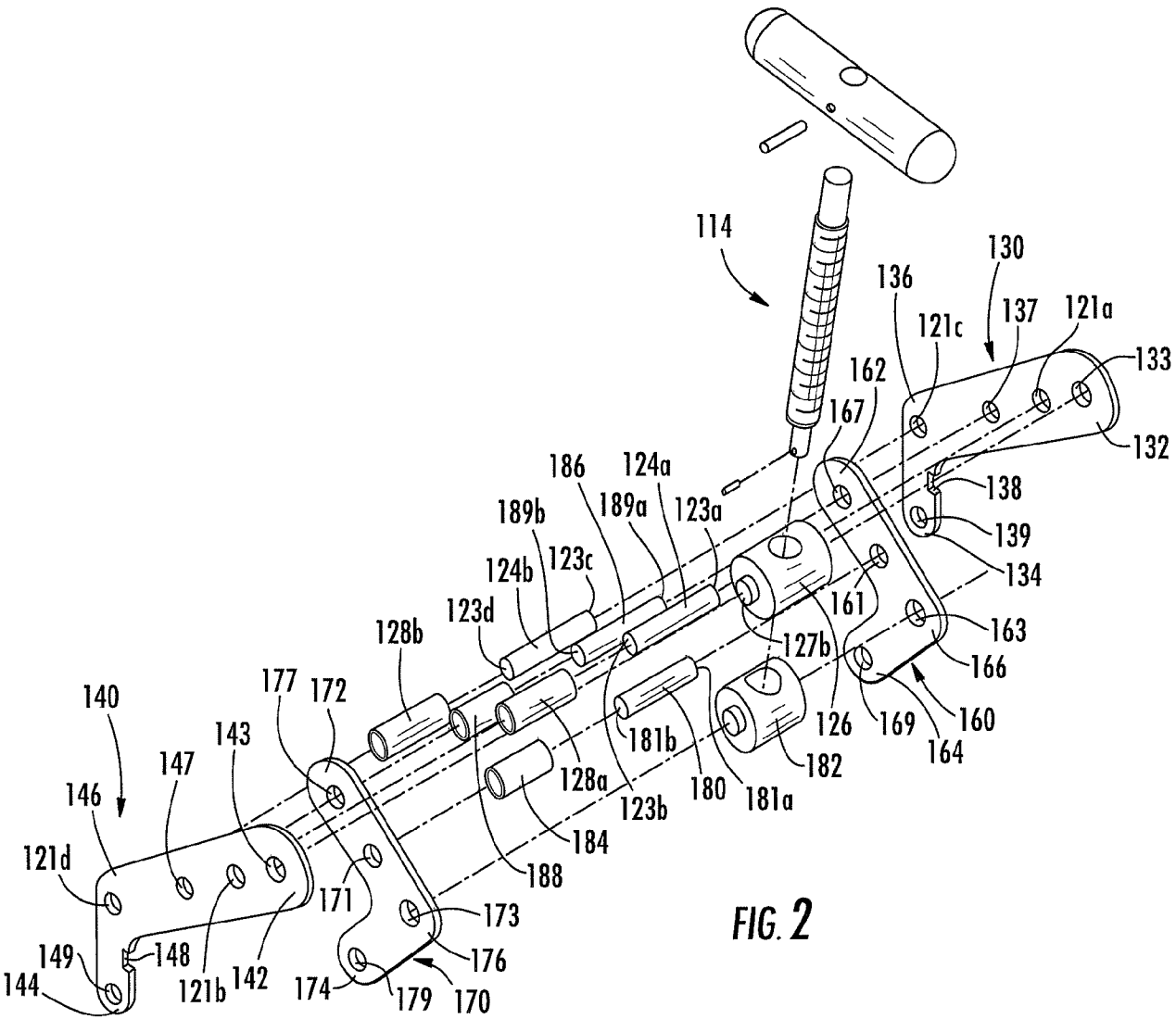
FIG. 2 is a partial exploded view of the waveguide quick disconnect clamp shown in FIG. 1.

Referring to FIG. 2, first J-shaped plate 130 has a first end 132, a second end 134, a bend 136, and a notch 138, and second J-shaped plate 140 has a first end 142, a second end 144, a bend 146 and a notch 148. First and second J-shaped plates 130 and 140 are connected to each other by two first arm pins 124*a* and 124*b* and a generally cylindrical nut 126. First arm pin 124*a* defines a first end 123*a* that is press-fit into a hole 121*a* in first J-shaped plate 130, and a second end 123*b* that is press-fit into a hole 121*b* in second J-shaped plate. Pin 124*a* is received in a bushing 128*a* that is positioned intermediate the J-shaped plates and that ensures that the J-shaped plates remain properly spaced apart from one another. Similarly, pin 124*b* defines a first end 123*c* that is press-fit into a hole 121*c* in first J-shaped plate 130, and a second end 123*d* that is press-fit into a hole 121*d* formed in second J-shaped plate 140. Pin 124*b* is received in a bushing 128*b* that is positioned intermediate the J-shaped plates to ensure that the plates are properly spaced and aligned. It should be understood that alternative means of attaching the first and second J-shaped plates may be used, for instance, rivets, threaded fasteners, and welded rods are suitable substitutes and are therefore contemplated as alternative embodiments.

Figure 3:
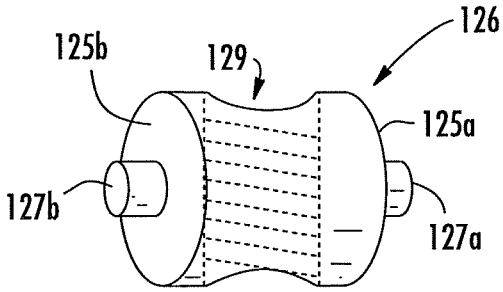
FIG. 3 is a perspective view of a nut for use in the waveguide quick disconnect claim of FIG. 1.

Referring to FIG. 3, nut 126 is generally cylindrical and has two opposite end surfaces 125*a* and 125*b* each defining a respective spindle 127*a* and 127*b*. Spindle 127*a* is pivotally received in a hole 133 (FIG. 2) formed in first J-shaped plate first end 132, and spindle 127*b* is pivotally received in a hole 143 (FIG. 2) formed in second J-shaped plate first end 132. Nut 126 also has a threaded radial though hole 129 that receives adjustment screw 114 (FIG. 1) as described below.

Referring again to FIGS. 1 and 4, first arm clamping jaw 120 is pivotally connected to first arm 110 and has a generally U-shaped clamping face 150 that defines a waveguide section receiving recess 151. First arm clamping jaw 120 also defines four generally triangular mounting plates 152*a*, 152*b*, 152*c* and 152*d* that extend rearward from clamping face 150. The vertex of each mounting plate 152*a*, 152*b*, 152*c* and 152*d* defines a respective hole 154*a*, 154*b*, 154*c*, and 154*d*, which align to receive pivot pins 156*a* and 156*b*.

First J-shaped plate second end 134 is received intermediate mounting plates 152*a* and 152*b* so that first jaw mounting plate holes 154*a* and 154*b* align with first J-shaped plate mounting hole 139. Pivot pin 156*a* is inserted through clamping jaw mounting plate holes 154*a* and 154*b* and first J-shaped plate mounting hole 139. Similarly, second J-shaped plate second end 144 is inserted intermediate mounting plates 152*c* and 152*d* so that first jaw mounting plate holes 154*c* and 154*d* align with first J-shaped plate mounting hole 149. Pivot pin 156*b* is inserted through clamping jaw mounting plate holes 154*c* and 154*d* and second J-shaped plate mounting hole 149. In this way, first arm clamping jaw 120 is pivotally connected to the respective second ends of first and second J-shaped plates.

Referring to FIGS. 1 and 2, second arm 112 has a first C-shaped plate 160 and a second C-shaped plate 170, each having a respective first end 162 and 172, a respective second end 164 and 174, and a respective bend 166 and 176. First and second C-shaped plates 160 and 170 are connected to each other by a second arm pin 180 and a thrust bearing 182. Second arm pin 180 defines a first end 181*a* and a second end 181*b* that are press-fit into a respective hole 161 and 171 formed in first and second C-shaped plates 160 and 170, respectively. Second arm pin 180 is received in a bushing 184 surrounds that is positioned intermediate the C-shaped plates to ensure that the C-shaped plates remain properly spaced. As previously mentioned with respect to first arm 110, it should be understood that alternative means of attaching the first and second C-shaped plates may be substituted for the pins and bushings, such as rivets, threaded fasteners, or welded rods.

Figure 5:
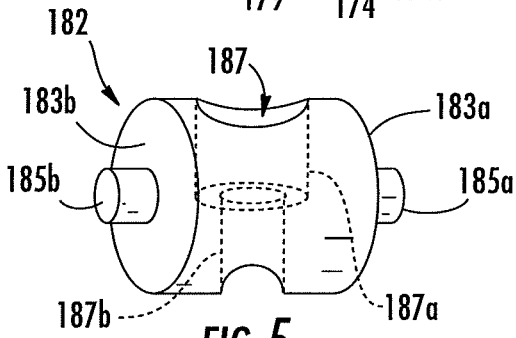
FIG. 5 is a perspective view of a thrust bearing for use in the waveguide quick disconnect clamp of FIG. 1.

Referring FIG. 5, thrust bearing 182 has two opposite end surfaces 183*a* and 183*b* that each defines a respective spindle 185*a* and 185*b*. Spindle 185*a* is pivotally received in a hole 163 (FIG. 2) formed in first C-shaped plate bend 166, and spindle 185*b* is pivotally received in a hole 173 (FIG. 2) formed in second C-shaped plate bend 176. Thrust bearing 182 also has a counterbored radial hole 187 that receives adjustment screw 114 (FIG. 2) as described below.

Figure 4:
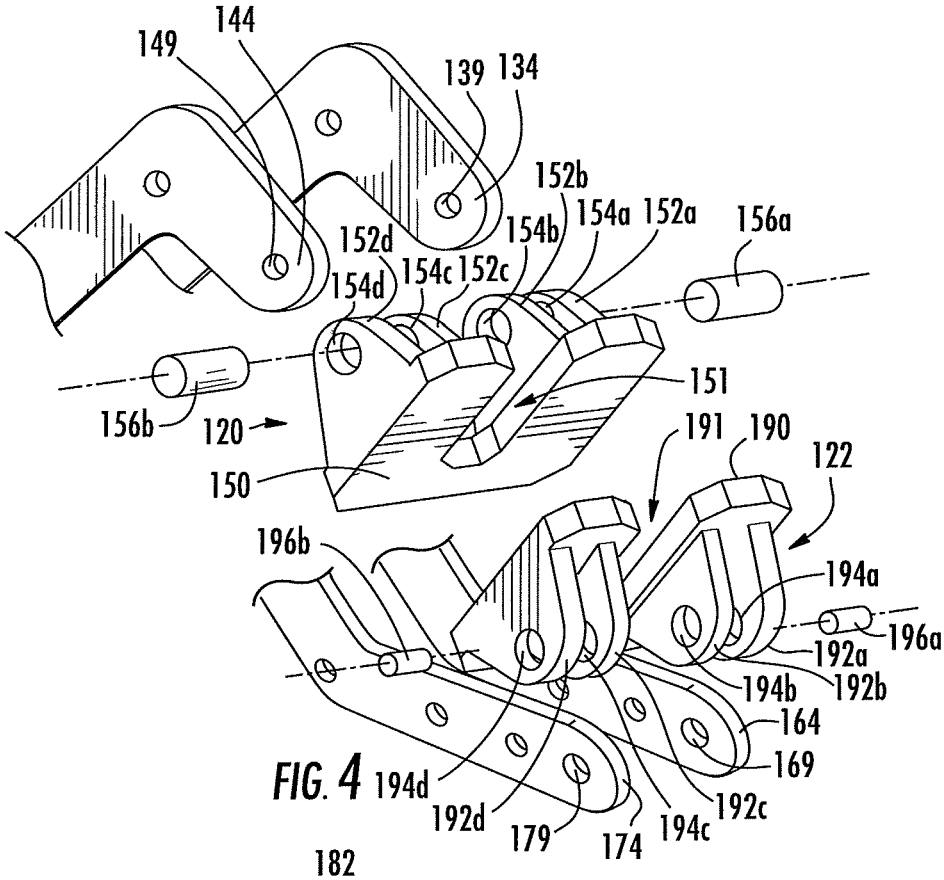
FIG. 4 is a partial exploded view of the waveguide quick disconnect clamp shown in FIG. 1.

Referring to FIGS. 1 and 4, second arm clamping jaw 122 is pivotally connected to second arm 112 and has a generally U-shaped clamping face 190 that defines a waveguide section receiving recess 191. Second arm clamping jaw 122 also defines four generally triangular mounting plates 192*a*, 192*b*, 192*c*, and 192*d* that extend rearward from clamping face 190 and define a respective mounting hole 194*a*, 194*b*, 194*c*, and 194*d*. First C-shaped plate second end 164 is inserted between mounting plates 192*a* and 192*b* so that mounting holes 194*a* and 194*b* align with a mounting hole 169 formed in first C-Shaped plate second end 164. A pivot pin 196*a* is inserted through the clamping jaw mounting holes and the first C-shaped plate mounting hole. Similarly, second C-shaped plate second end 174 is inserted between mounting plates 192*c* and 192*d* such that second mounting holes 194*c* and 194*d* align with a mounting hole 179 formed in the second end of second C-shaped plate 170. Pivot pin 196*b* is inserted through the clamping jaw mounting holes and the second C-shaped plate mounting hole. In this way, second arm clamping jaw 122 is pivotally connected to the respective C-shaped plate second ends.

Referring back to FIG. 1, first arm 110 and second arm 112 are pivotally connected to each other by a pivot pin 186. Referring to FIG. 2, pivot pin 186 defines a first end 189*a* and a second end 189*b*. Pivot pin first end 189*a* is received through a pivot hole 167 formed in first C-shaped plate first end 162 and is press-fit into a hole 137 formed in first arm first J-shaped plate 130 positioned intermediate plate first end 132 and bend 136. Likewise, pivot pin second end 189*b* is received through a pivot hole 177 formed in second C-shaped plate first end and is press-fit into a hole 147 formed in first arm second J-shaped plate 140 positioned intermediate plate first end 142 and bend 146. The pivotal engagement between first and second C-shaped plate pivot holes 167 and 177 and pivot pin 186 allows second arm 112 to pivot with respect to first arm 110. Pivot pin 186 is received in a bushing 188 that is positioned intermediate second arm first and second C-shape plates 160 and 170, which ensures that the C-shaped plates remain properly spaced apart during operation. During assembly, the first arm J-shaped plates are positioned such that the J-shaped plate bends 136 and 146 are convex with respect to second arm 112, and the second arm C-shaped plates are positioned such that the C-Shaped plate bends 166 and 176 are convex with respect to first arm 110.

Figure 6:
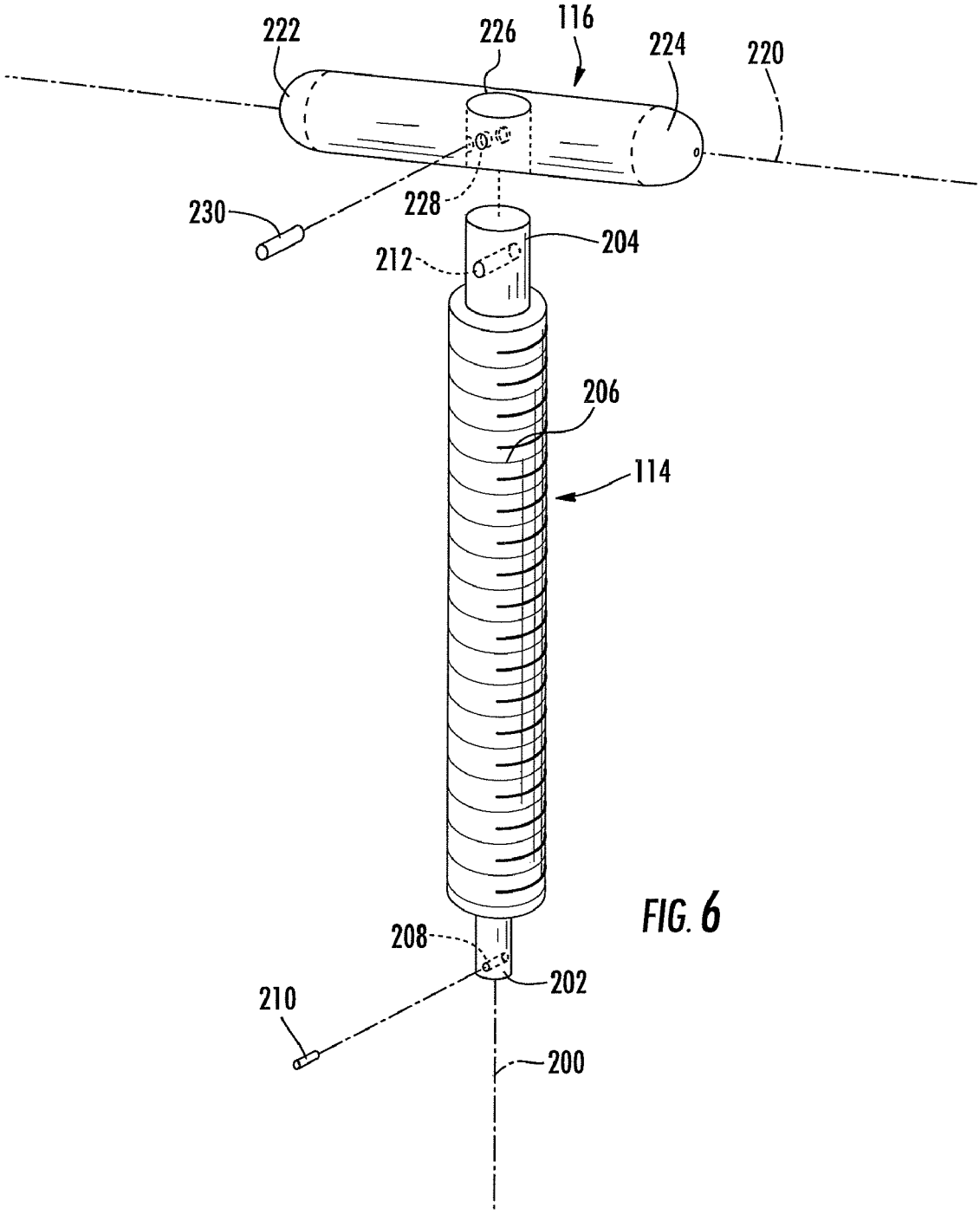
FIG. 6 is an exploded view of an adjustment screw for use in the waveguide quick disconnect clamp of FIG. 1.

Referring to FIG. 6, adjustment screw 114 has a central longitudinal axis 200, a first end 202, a second end 204, and a threaded portion 206 intermediate the first and second ends. Threaded portion 206 has a larger diameter than both screw first and second ends, and in one preferred embodiment, the threads are ⅜-inch Acme screw threads. However, it should be understood that any suitable screw thread size may be substituted depending on the clamping force necessary to effectively attach two adjacent waveguides. The minimum clamping force is normally set forth by the waveguide manufacture.

Thrust bearing radial hole 187 (FIG. 5) rotatably receives screw first end 202 so that the larger diameter of adjustment screw threaded portion 206 seats in a counterbored portion 187*a* of the thrust bearing radial hole while the screw first end extends through a through-hole portion 187*b* (FIG. 5). A radial hole 208, formed in adjustment screw first end 202, is sized appropriately to receive a locking pin 210. Therefore, once adjustment screw first end 202 is inserted into thrust bearing counterbored hole 187, locking pin 210 is press-fit into screw radial hole 208 such that the two ends of the locking pin extend outwardly from the radial hole (FIG. 8) and prevent adjustment screw first end 202 from sliding out of thrust bearing radial hole 187. Screw threaded section 206 is rotatably received in nut threaded radial hole 129 (FIGS. 3 and 8) so that rotation of screw 114 advances or retracts nut 126 along screw longitudinal axis 200 depending upon the direction in which screw 114 rotates.

Referring again to FIG. 6, handle 116 defines a central longitudinal axis 220, two opposite ends 222 and 224, and a first radial hole 226 positioned perpendicular to handle longitudinal axis 220 and located intermediate the handle opposite ends 222 and 224. First hole 226 is sized appropriately to receive adjustment screw second end 204. Handle 116 further defines a second radial hole 228 that is transverse to handle first radial hole 226, and adjustment screw second end 204 defines a corresponding radial hole 212 both of which are sized appropriately to receive a locking pin 230. Once adjustment screw second end 204 is inserted into handle first radial hole 226 such that the edge of threaded portion 206 abuts the handle, locking pin 230 is press-fit into both handle second radial hole 228 and adjustment screw second end radial hole 212. Because handle 116 is rotationally and axially fixed to adjustment screw second end by pin 230, handle 116 can be used to apply torque to adjustment screw 114 to open and close clamp 100. It should be understood that alternative means for attaching handle 116 to screw second end 204 may be employed with similar results. For example, a keyway and key arrangement or a press fit may be used to attach screw second end to handle first radial hole 226. Additionally, screw 114 and handle 116 may be manufactured as a unitary piece.

Figure 7:
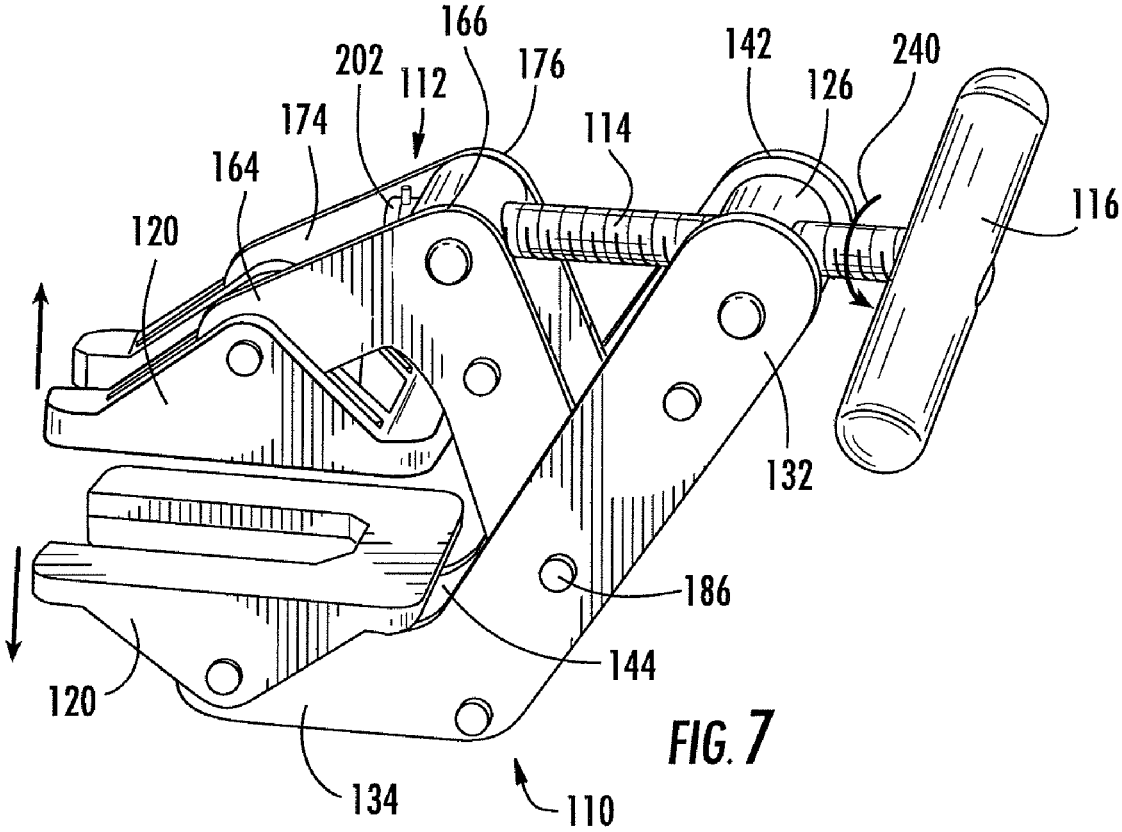
FIG. 7 is a perspective view of the waveguide quick disconnect clamp shown in FIG. 1.

With reference to FIG. 7, operation of the waveguide quick disconnect clamp will now be described. Prior to assembling a sectional RF waveguide, an operator rotates screw handle 116 in direction 240 such that nut 126 advances along adjustment screw 114 from a position proximate to screw second end 204 towards screw first end 202. The advancement of nut 126 in this direction forces first arm J-shaped plate first ends 132 and 142 to follow the motion of the nut, and, as a result, the J-shaped plate first ends and the second arm C-shaped plate bends 166 and 176 advance toward each other. Second arm 112 pivots about pivot pin 186 with respect to first arm 110, and the result is that first arm clamping jaw 120 spreads away from second arm clamping jaw 122. The operator continues to turns handle 116 until adjustment screw 114 advances far enough to spread first arm clamping jaw 120 and second arm clamping jaw 122 sufficiently to begin assembling waveguide sections.

Figure 8:
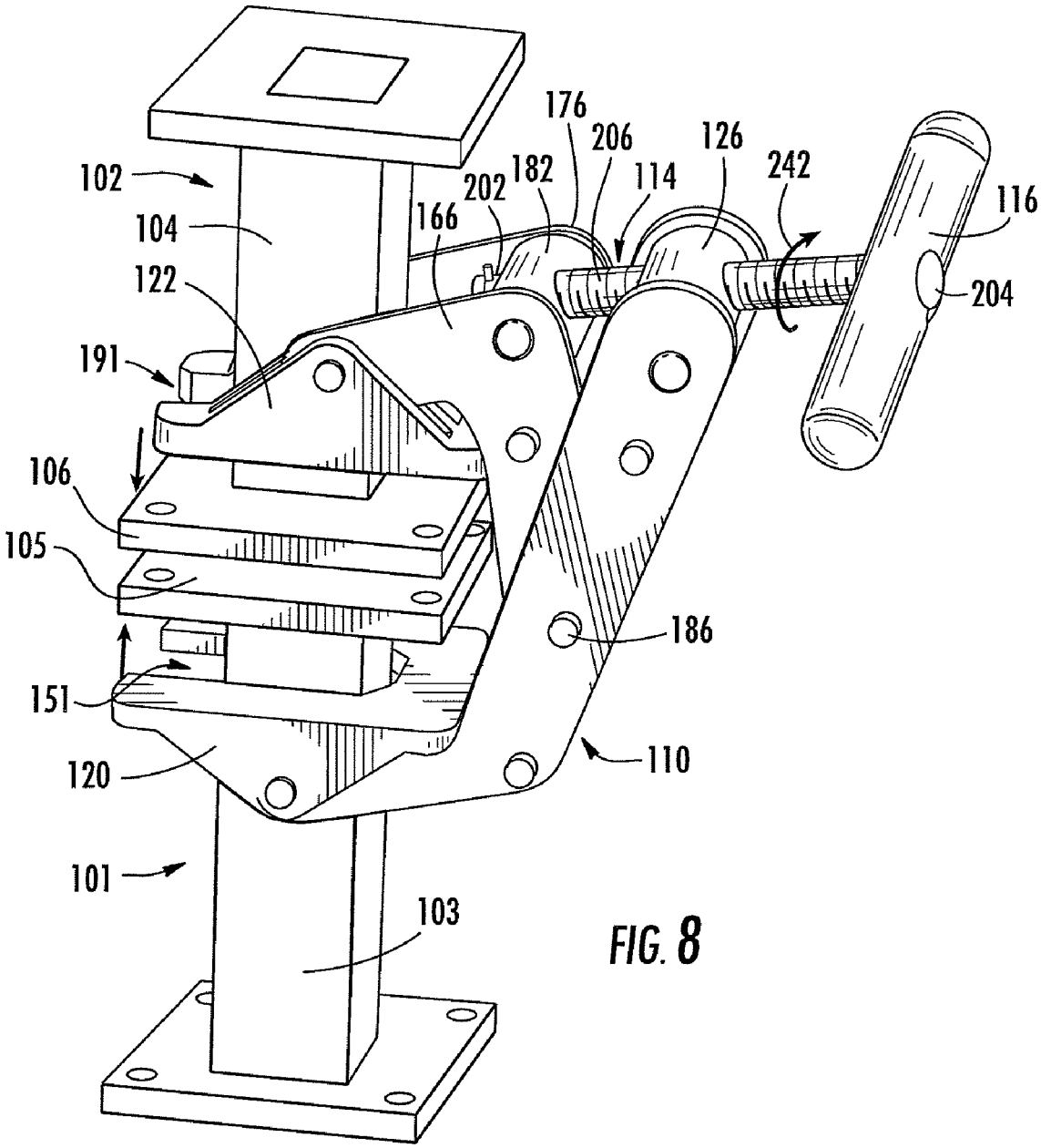
FIG. 8 is a perspective view of the waveguide quick disconnect clamp shown in FIG. 1 in operation on two adjacent waveguides.

Referring to FIG. 8, two mating waveguide sections 101 and 102 are each equipped with a respective RF wave guiding channel 103 and 104 and a respective mating flange 105 and 106. First waveguide section 101 is inserted into first arm jaw recess 151 such that first arm jaw face 150 can engage flange 105. Similarly, second waveguide section 102 is inserted into second arm jaw recess 191 (FIG. 4) such that second arm jaw face 190 engages flange 106. Once waveguide sections 101 and 102 are properly inserted into their respective jaws, the operator rotates handle 116 in direction 242, which causes nut 126 to advance along screw threaded section 206 toward screw first end 202. As nut 126 advances, the distance between thrust bearing 182 and nut 126 along adjustment screw 114 increases causing second arm 112 to pivot about pivot pin 186. As second arm 112 pivots, second arm jaw 122 approaches first arm jaw 120, and waveguide mating flange 105 approaches its opposing waveguide mating flange 106. Nut spindles 127*a* and 127*b* (FIG. 2) pivot within their respective J-shaped plate holes 133 and 143 (FIG. 2), and thrust bearing spindles 183*a* and 183*b* (FIG. 2) pivot within their respective C-shaped plate holes 163 and 173 (FIG. 2). This pivotal action allows nut 126 and thrust bearing 182 to respond to the changing angular position of adjustment screw 114 with respect to first arm 110 and second arm 112. Therefore, the adjustment screw will not bind as jaws 120 and 122 approach each other.

The operator continues to turn adjustment screw 114 in jaw-closing direction 242 until second arm jaw 122 brings waveguide flange 106 into contact with waveguide flange 105. Before fully tightening, the operator may pivotally adjust first arm jaw 120 and second arm jaw 122 to ensure that waveguide sections 101 and 102 are properly aligned so that guiding channels 103 and 104 communicate and facilitate optimal propagation of the RF signals through the assembled waveguide sections. Once the sections are properly aligned, the operator may resume turning adjustment screw 114 in jaw-closing direction 242 until flanges 105 and 106 properly and securely engage each other. To disassemble waveguide sections 101 and 102, an operator simply turns adjustment screw 114 in jaw-opening direction 240 (FIG. 7) until nut 126 advances toward adjustment screw first end 202 sufficiently to allow the removal of waveguide sections 101 and 102 from their respective jaw recesses 151 and 191.

In prior art methods of assembling the waveguide sections, a bolt was inserted thorough a hole defined in each corner of the mating waveguide section flanges. The operator would then tighten a nut onto the bolt to compress the mating flanges together. As a result, the maximum contact forces between the waveguide section flanges occurred at the four flange corners where the bolts were tightened, but the contact forces decreased along each side of the flange toward the mid point between the two corner bolts. Such non-uniform contact forces may result in an improper seal between the mating waveguide section flanges especially if the fasteners were not properly tightened. The present invention addresses such non-uniform contact forces by providing jaws 120 and 122 with generally U-shaped jaw faces 150 and 190. As the waveguide clamp is tightened, the jaw faces apply a continuously and evenly distributed compressive force along three edges of the waveguide section flanges and ensures that the waveguide section flanges are securely and properly mated together.

Figure 9:
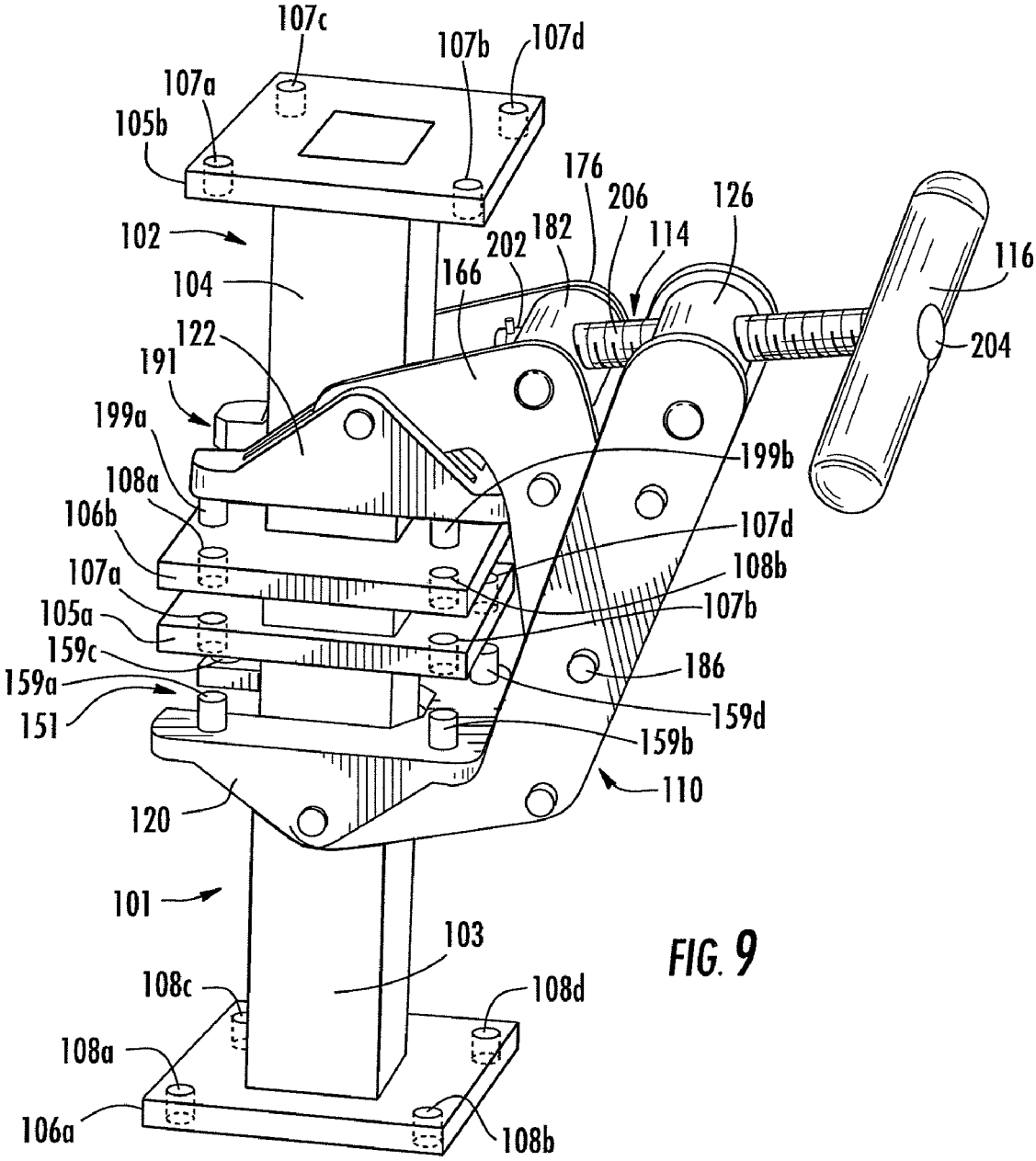
FIG. 9 is a perspective view of a waveguide quick disconnect clamp in accordance with an embodiment of the present invention.

Referring to FIG. 9, an alternative embodiment provides jaw alignment pins that may be used improve the alignment of the waive guide sections. Waveguide section 101 has a first flange 105*a* that defines four alignment holes (only three are visible, 107*a*, 107*b*, and 107*d*), and a second flange 106*a* that defines four alignment holes 108*a*, 108*b*, 108*c*, and 108*d*. Similarly, second waveguide section 102 has a first flange 105*b* that defines four alignment holes 107*a*, 107*b*, 107*c*, and 107*d*, and a second flange 106*b* that defines four alignment (only two are visible, 108*a* and 108*b*). It should be understood that flanges 105*a* and 106*a* of first waveguide section 101 are identical to the corresponding flanges 105*b* and 106*b* of second waveguide section 102. Waveguide first jaw 120 defines four alignment posts 159*a*, 159*b*, 159*c*, and 159*d* that are each received by a respective alignment hole formed in first waveguide first flange 105*a*, and waveguide second jaw 122 defines four alignment posts (only two are visible, 199*a* and 199*b*) that are each received by a respective second alignment hole formed in second waveguide second flange 106*b*. Thus, prior to clamping the waveguide flanges together, the user places each end of the waveguides in its respective waveguide jaw and positions the waveguide jaw posts in their respective holes in the flange. Once in this position, the user than closes the waveguide clamp. The engagement between the first and second jaw alignment posts and the waveguide flange alignment holes prior to clamping helps to ensure that the waveguides maintain proper alignment as the clamp is closed.

Figure 10:
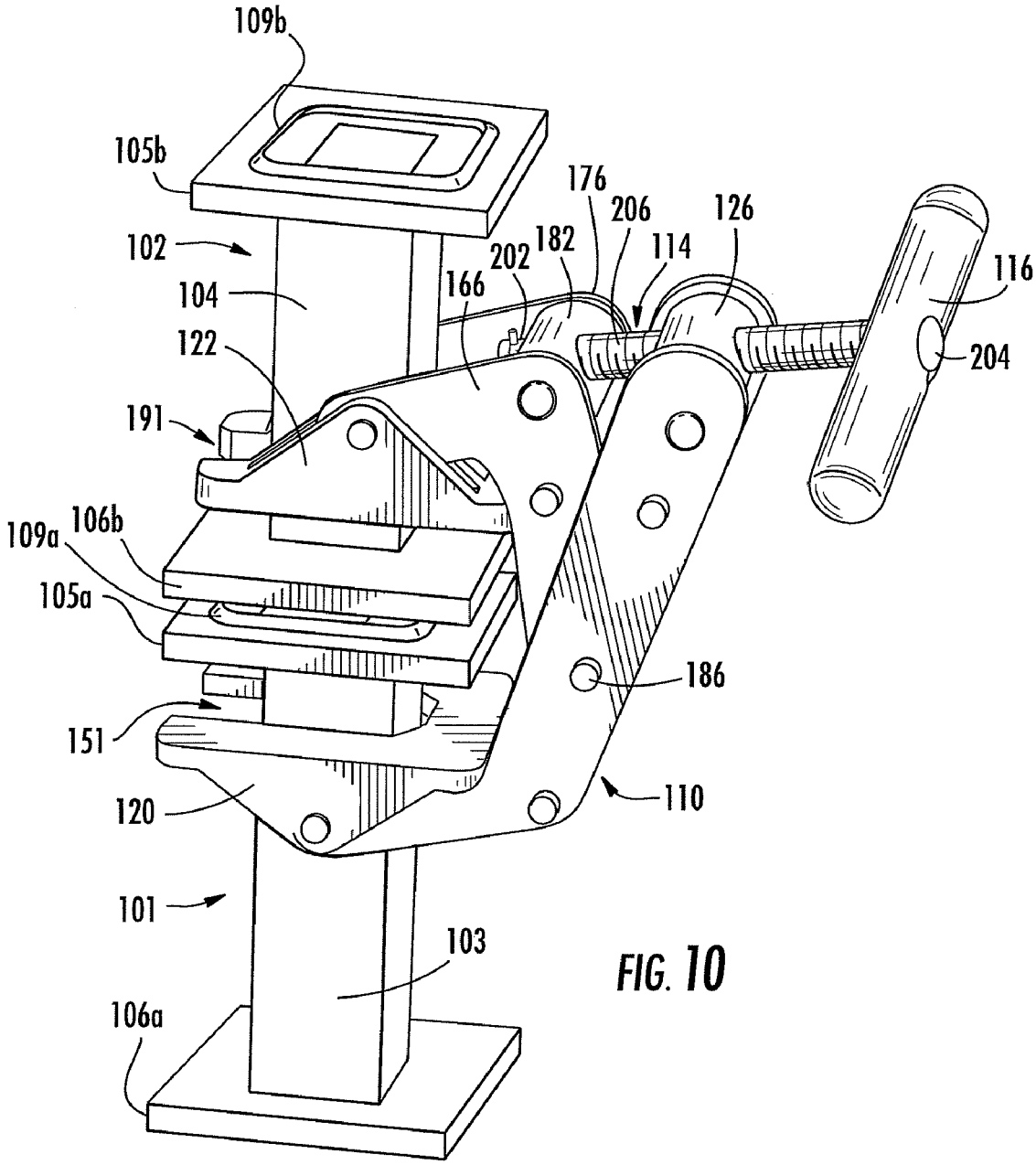
FIG. 10 is a perspective view of a waveguide quick disconnect clamp in accordance with an embodiment of the present invention.

FIG. 10 shows yet another embodiment for properly aligning waveguide sections 101 and 102. First waveguide section 101 defines a first flange 105*a* and a second flange 106*a*, and second waveguide section 102 defines a first flange 105*b* and a second flange 106*b*. First flanges 105*a* and 105*b* each define a respective male alignment bead 109*a* and 109*b*. The male alignment beads are received in a corresponding female alignment groove (not shown) defined in each second flange 106*a* and 106*b*. In this way, as the waveguide clamp closes, the male alignment beads will seat in the female alignment grove provided in the mating waveguide section flange. Waveguide jaws 120 and 122 swivel to allow the proper alignment of the male beads and the female grooves as the waveguide clamp closes to join the flanges together.

Figure 11:
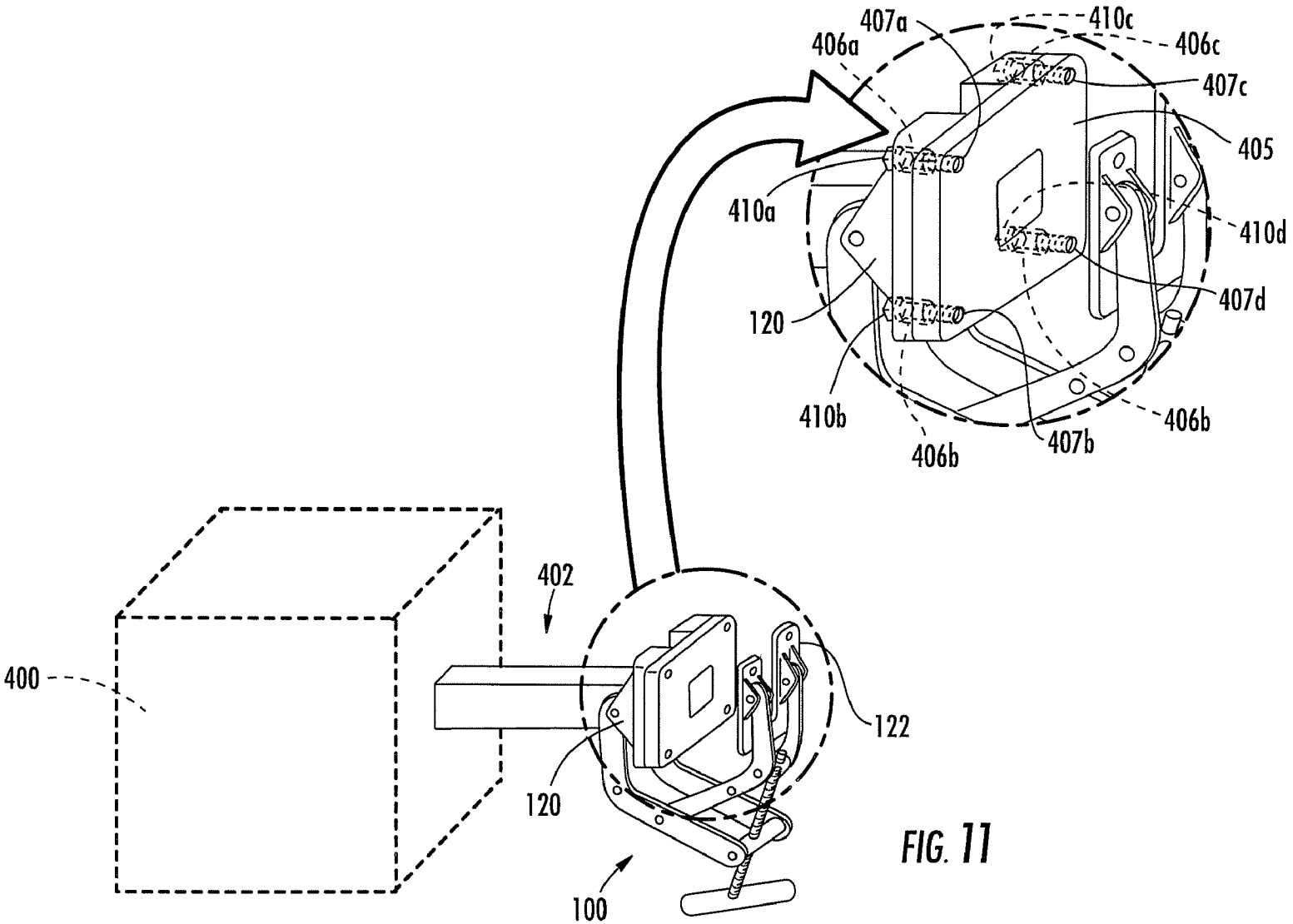
FIG. 11 is a perspective view of a radio frequency generating system in accordance with an embodiment of the present invention.

FIG. 11 shows a waveguide clamp 100 in a time-saving configuration where radio-frequency equipment 400 has an integral waveguide section 402 with a flange 405 that defines four threaded mounting holes 407*a*, 407*b*, 407*c*, and 407*d*. Radio-frequency equipment 400 may be any electronic component, such as a transmitter, a receiver a transceiver, an oscillator, an antenna, or the like. Waveguide clamp jaw 120 defines four through-holes 406*a*, 406*b*, 406*c*, and 406*d* that each receives one of bolts 410*a*, 410*b*, 410*c* and 410*d*. The bolts are long enough to securely fix the flange to first arm jaw 120 but do not extend beyond the flange surface. The user may initially secure first arm jaw 120 to waveguide flange 405, while the second arm jaw remains free to accept a mating waveguide section. After securing the waveguide clamp first arm jaw to the waveguide flange, the waveguide clamp may remain bolted to the waveguide flange at all times.

This arrangement greatly simplifies the assembly of the waveguide sections because the operator only needs to insert the mating wave guide section into the free second arm jaw of the waveguide clamp and then tighten the waveguide clamp screw. Likewise, disassembly of the waveguide requires only that the user loosen the waveguide clamp screw sufficiently to remove the mating wave guide section from the waveguide clamp. The waveguide clamp may also be bolted to a flange of waveguide sections that are not attached to radio frequency equipment to further simplify the waveguide assembly process. Such arrangement also ensures that the waveguide clamps are not lost during disassembly or transport of the device.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. A waveguide quick disconnect clamp comprising a. a first arm having a first jaw pivotally connected at a first end of said first arm;

b. a second arm having a second jaw pivotally connected at a first end of said second arm; and c. an adjustment screw rotatably coupled to said second arm and threadably coupled to said first arm, wherein each of said first arm jaw and said second arm jaw has a recess formed therein for receiving a respective waveguide end therein.

2. The waveguide quick disconnect clamp according to claim 1, further comprising a threaded nut coupled to said first arm, wherein said adjustment screw is threadedly engaged with said threaded nut.

3. The waveguide quick disconnect clamp according to claim 2, wherein said threaded nut is coupled to a second end of said first arm.

4. The waveguide quick disconnect clamp according to claim 2, said second arm having a second end, wherein said adjustment screw is rotatably coupled to said second arm intermediate said second arm first and second ends.

5. The waveguide quick disconnect clamp according to claim 1, wherein a second end of said second arm is pivotally coupled to said first arm.

6. The waveguide quick disconnect clamp according to claim 1, wherein said adjustment screw further comprises a handle at one end and a threaded portion intermediate said handle and a second end of said adjustment screw.

7. The waveguide quick disconnect clamp according to claim 5, wherein said second arm further comprises a bend intermediate said second arm first and second ends, and a thrust bearing pivotally connected to said second arm bend section, said thrust bearing pivotally engaging said adjustment screw first end.

8. The waveguide quick disconnect clamp according to claim 1, wherein each of said first and said second jaws have a U-shaped base having substantially parallel side walls.

9. The waveguide quick disconnect clamp according to claim 1, further comprising a connector coupled to said second arm intermediate said second arm first and second ends, said connector having a bore formed therein, wherein said connector bore is configured to receive a first end of said adjustment screw.

10. The waveguide quick disconnect clamp according to claim 9, wherein said adjustment screw first end is axially fixed to said connector but rotatable with respect to said connector.

11. A waveguide quick disconnect clamp comprising:

a. a first arm having i. a first end defining a first recess therein;

ii. an opposite second end, and iii. a threaded first bore, wherein said first recess is configured to receive an end of a first waveguide;

b. a second arm having i. a first end defining a second recess therein, ii. an opposite second end, and iii. a second bore wherein said second recess is configured to receive an end of a second waveguide; and c. an adjustment screw rotatably coupled to said second arm and threadably coupled to said first arm threaded bore, said adjustment screw having a first end and an opposite second end, wherein said first arm is pivotally coupled to said second end.

12. The waveguide quick disconnect clamp according to claim 11 wherein said adjustment screw further comprises a handle affixed to said adjustment screw second end.

13. The waveguide quick disconnect clamp according to claim 12, wherein said second arm second bore pivotally supports said adjustment screw first end.

14. The waveguide quick disconnect clamp according to claim 13, wherein said second arm second bore is axially fixed with respect to said adjustment screw first end.

15. The waveguide quick disconnect clamp according to claim 11, further comprising a. a first jaw pivotally coupled to said first arm first end, said first jaw defining said first recess; and b. a second jaw pivotally coupled to said second arm second end, said second jaw defining said second recess.

16. The waveguide quick disconnect clamp according to claim 15, wherein each of said first jaw and said second jaw comprise a first leg and a second leg spaced apart and substantially parallel to one another, thereby defining respectively said first and said second recesses there between.

17. The waveguide quick disconnect clamp according to claim 11, wherein said pivotal connection of said first arm to said second arm is at a point intermediate said second arm first and second ends.

18. The waveguide quick disconnect clamp according to claim 17, wherein said pivotal connection is located at an apex defined by a bend in said second arm.

19. A radio frequency system comprising:

a. a radio frequency device having at least one waveguide extending therefrom, said waveguide having i. a transmission channel defining a first end, and a second end defining a radial flange formed perpendicular to an axis of said transmission channel, wherein said first end is coupled with said radio frequency device, b. a waveguide quick disconnect clamp comprising:

i. a first arm having a first end defining a first recess therein;

an opposite second end, and a threaded first bore; and ii. a second arm having a first end defining a second recess therein, an opposite second end, and a second bore; and iii. an adjustment screw rotatably coupled to said second arm and threadably coupled to said first arm threaded bore, said adjustment screw having a first end and an opposite second end, wherein said first arm is pivotally coupled to said second end, and said first arm first recess receives said waveguide second end so that said waveguide second end flange is adjacent a portion of said first arm.

20. The waveguide quick disconnect clamp according to claim 19, wherein said waveguide disconnect clamp first arm is releasably attached to said waveguide second end.

* * * * *